US006116042A

United States Patent [19]

Purdum

[11] Patent Number: 6,116,042

[45] **Date of Patent: *Sep. 12, 2000**

[54] CONTAINER FOR TRANSPORTATION OF TEMPERATURE SENSITIVE PRODUCTS

[75] Inventor: Howard E. Purdum, Alpharetta, Ga.

[73] Assignee: Throwleigh Technologies, LLC, Ball Ground, Ga.

[ * ] Notice: This patent is subject to a terminal disclaimer.

[21] Appl. No.: 09/101,282

[22] PCT Filed: Oct. 11, 1996

[86] PCT No.: PCT/US96/16243

§ 371 Date: Mar. 4, 1999

§ 102(e) Date: Mar. 4, 1999

[87] PCT Pub. No.: WO97/17580

PCT Pub. Date: May 15, 1997

Related U.S. Application Data

[60] Provisional application No. 60/007,302, Nov. 6, 1995.

[51] Int. Cl.[7] ..... F25O 3/08

[52] U.S. Cl. ..... 62/371; 62/457.2; 62/530

[58] Field of Search ..... 62/371, 457.2, 62/530, 457.1, 529, 372, 457.7

[56] References Cited

U.S. PATENT DOCUMENTS

| | | | |
|---|---|---|---|
| 881,025 | 3/1908 | Parker . | |
| 2,507,929 | 5/1950 | Pennebaker | 229/14 |
| 2,954,913 | 10/1960 | Rossman | 229/14 |
| 3,762,626 | 10/1973 | Dorsey | 229/14 |
| 4,287,265 | 9/1981 | McKnight | 428/542 |
| 4,292,817 | 10/1981 | Loucks | 62/457 |
| 4,470,264 | 9/1984 | Morris | 62/60 |
| 4,573,581 | 3/1986 | Galloway et al. | 206/570 |
| 4,576,017 | 3/1986 | Combs et al. | 62/372 |
| 4,721,237 | 1/1988 | Leslie | 224/148 |
| 4,730,748 | 3/1988 | Bane | 220/400 |
| 4,742,916 | 5/1988 | Galea | 206/586 |
| 4,838,427 | 6/1989 | Hurley | 206/586 |
| 4,889,252 | 12/1989 | Rockom et al. | 220/3.1 |
| 4,923,065 | 5/1990 | Ridgeway | 206/583 |
| 4,955,480 | 9/1990 | Sexton | 206/528 |
| 5,071,009 | 12/1991 | Ridgeway | 206/586 |
| 5,103,651 | 4/1992 | Coelho et al. | 62/341 |
| 5,154,309 | 10/1992 | Wischusen, III et al. | 220/403 |
| 5,175,041 | 12/1992 | Webb et al. | 428/116 |
| 5,236,088 | 8/1993 | Dhority et al. | 206/438 |
| 5,313,809 | 5/1994 | Isaacson et al. | 62/530 |
| 5,417,082 | 5/1995 | Foster et al. | 62/457.1 |
| 5,419,152 | 5/1995 | Silber | 62/372 |
| 5,435,142 | 7/1995 | Silber | 62/60 |
| 5,899,088 | 5/1999 | Purdum | 62/371 |

FOREIGN PATENT DOCUMENTS

| | | |
|---|---|---|
| 0 475 144 A2 | 3/1992 | European Pat. Off. . |
| 9000585 U | 5/1990 | Germany . |
| 2068521A | 8/1981 | United Kingdom . |
| 2192262A | 1/1988 | United Kingdom . |
| WO 93/11055 | 6/1993 | WIPO . |

*Primary Examiner*—Henry Bennett
*Assistant Examiner*—Melvin Jones
*Attorney, Agent, or Firm*—Needle & Rosenberg, P.C.

[57] ABSTRACT

A heat transfer device for a container defining a cavity (134) therein, the device having a heat transfer solution for cooling the cavity and reservoir-defining element (143) with a channel (148) which is in communication with the cavity (134) and which is disposed substantially in the direction of the flow of air through the cavity. A container (110) for transporting a temperature-sensitive product, the container having a reclosable, insulated housing defining a cavity therein, a product carrying container having a plurality of corners (140) and capable of being disposed within the cavity, and a plurality of the devices as described elsewhere herein, the plurality of devices disposed within the cavity so as to engage the corresponding plurality of corners of the product carrying container.

17 Claims, 6 Drawing Sheets

CONTAINER FOR TRANSPORTATION OF TEMPERATURE SENSITIVE PRODUCTS

RELATED CASE

This application is a continuation-in-part of Applicant's copending U.S. Ser. No. 60/007,302, filed Nov. 6, 1995, the contents of which are hereby incorporated, in its entirety, by this reference.

BACKGROUND OF THE INVENTION

1. Field of the Invention

The invention relates to containers. In particular, the present invention discloses containers suitable for transporting temperature sensitive products, such as human blood products.

2. Background Art

The conventional means of shipping blood and blood products involves the use of an insulated box, with the necessary shipping and warning labels, along with some cooling agent. These cooling agents are typically a frozen gel, dry ice, or glistening (wet) ice.

There are, however, several problems with the conventional approach. First, the styrofoam used for insulation does not degrade readily, leading to disposal problems. These problems are so severe that many countries ban the use of styrofoam, thus severely restricting international shipments of biological materials. Second, the cooling agents also present numerous practical problems in field use. Specifically, gel systems are often too expensive for routine use and disposal. As for dry ice, the carbon dioxide gas evolved during shipment is so dangerous to shipping personnel that hazard warnings must be posted and additional fees paid; furthermore, outright bans on dry ice are pending in several areas. Finally, wet ice poses handling problems in packing, as well as leakage and product soaking problems.

Existing shipping systems also suffer from other serious problems. First, many systems do not employ coolants in the proper temperature range. For example, one company ships vaccine packed in dry ice, even through the specification for storage is approximately −15° C. The result of this practice is excessive cooling, resulting in damage to the vaccine.

Another problem often observed with conventional systems is failure to maintain the proper temperature over time, due to inadequate insulation and/or inadequate cooling pack capacity. Again, the end result is product damage.

Yet another problem commonly observed with conventional shipping systems is a strong sensitivity to infrared heat transfer. Specifically, many systems heat rapidly when left in direct sunlight. Part of this susceptibility may be due to the standard industry practice of testing shipping containers only in convective, non-radiative heating systems. While this practice is quite appropriate for shaded or otherwise protected systems, these results do not apply to the common situation of shipping containers left in direct sunlight on loading docks, etc.

An additional problem is that many boxes do not tolerate the condensation that results during conditions of high humidity. Common failures include box collapse due to dissolution of starch seals, as well as excessive swelling of the box walls themselves.

Finally, the vast majority of shipping systems do not provide uniform temperatures within the container. For example, one system that is currently used to transport blood samples for laboratory analysis consists of a set of frozen gel packs placed on a shelf at the top of a standard RSC (Rigid Shipping Container) cardboard box. Instrumented tests of this system, however, showed that only the samples immediately below the cooling packs were ever in the specified temperature range of 0 to 10° C.; furthermore, these samples were in this range for only 8 of the required 24 hour test duration, even at a mild ambient temperature of 22° C. Conversely, samples at the bottom of the box were never in the required temperature range, except for approximately 15 minutes after loading from the storage refrigerator. Less severe, but still significant, uniformity problems were also found for other shipping systems. Several of these systems showed extreme temperature inversions of 10° C. or more, typically the result of the placement of cooling media only at the top of the shipping system. Again, samples at the bottom of the box never receive adequate cooling. Similarly, the common problems of the failure of shipping personnel to obey "This Side Up" instructions also leads to inadequate cooling of some of the load.

The consequence of these observed problems of conventional shipping systems is damage to the material being transported. For biomedical materials, such as blood, blood products, pharmaceuticals, etc., loss of these products due to heat damage is critical because of the intrinsic financial value of these items and because of the potential hazards that the use of compromised materials presents. Likewise, heat damage to various foods also presents both financial and health consequences. Finally, the loss of flowers and other expensive, heat-sensitive materials presents serious problems to a variety of industries. Because all of the above industries currently experience substantial shipping losses, the commercial opportunity of the present invention is immense.

SUMMARY OF THE INVENTION

The present invention presents a heat transfer device for a container defining a cavity therein, comprising a heat transfer solution for cooling the cavity and means for containing the solution, the containing means comprising a reservoir-defining element having a channel therethrough which is in communication with the cavity and which is disposed on the element substantially in the direction of the flow of air through the cavity. In a further embodiment, the invention provides a device wherein the solution comprises a eutectic solution which has a preselected melting temperature. In a further embodiment, the reservoir-defining element comprises three substantially equally shaped triangular members, wherein each member comprises a front face, an opposite rear face, two vertical side walls interconnecting the faces, wherein each side wall has a first end and an opposed second end and the first ends of the side walls are joined together at a junction, a rear wall interconnecting the second ends of the side walls, with the front face, the rear face, the side walls and the rear wall defining the reservoir for each member, and means for forming a trigonally pyramidal shaped void defined by the three front faces of the members, wherein the channel is formed on each front face of each member in a direction which is perpendicular to the rear wall and intersects the junction of the two first ends of the side walls.

The present invention also provides a device wherein the three triangular members are arranged with one of the members intermediate the other two members such that a line through each junction of each member which is perpendicular to the rear wall of that member intersects each of the other lines at a point which is exterior to the members and is the center of the void and with each of the side walls of the intermediate member being parallel to a juxtaposed side wall of another member. In a further embodiment, the rear faces of the members are co-extensive and form a unitary surface and wherein a fold-line is disposed in the surface between, and parallel to, each of the juxtaposed sidewalls. In another further embodiment, a surface is formed at the intersection of the front face with each of a respective juxtaposed side wall, each of the surfaces being complementary in shape to each other. In yet a further embodiment, the shape of the surface is a chamfer.

In an alternative embodiment of the invention, the rear faces are coextensive and further comprising a means for securing the junction, wherein the side walls are disposed such that one member is intermediate the other two and its side walls are parallel to a side wall of each adjacent member and the side walls are spaced apart with a fold line disposed therebetween, and further having a means for joining together the non-intermediate members by folding along the fold-lines. In a further embodiment, the means for joining comprises a hook means disposed on a selected one of the non-intermediate members and a hook-receiving means disposed on the other non-intermediate member.

In addition, the present invention provides the above-described device further comprising separating means for preventing direct contact between the reservoir and a corner of the container. In a further embodiment, the separating means comprises one or more solution-free, raised protrusions on each of the front faces.

In yet another embodiment, the reservoir comprises a member having an outer surface and an inner surface, wherein the inner surface forms a trigonally pyramidal shaped void comprised of three triangular inner faces each having a base edge and an apex, and wherein the apexes of each of the triangular faces meet and further wherein each of the triangular faces is substantially bisected by a channel disposed from the apex to the base edge.

In an additional embodiment, the present invention provides a container for transporting a temperature-sensitive product, comprising a reclosable, insulated housing defining a cavity therein, a product carrying container having a plurality of corners and capable of being disposed within the cavity, and a plurality of the devices of the invention disposed within the cavity so as to engage the corresponding plurality of corners of the product carrying container. In a further embodiment, the present invention provides a container wherein the housing comprises a durable outer layer and an insulating inner layer, wherein the inner layer is comprised of spun rock. In yet another embodiment, the container is substantially fluid impermeable. In yet another further embodiment, the container is coated with an energy reflective material.

DETAILED DESCRIPTION OF THE PREFERRED EMBODIMENTS

Figure 1:
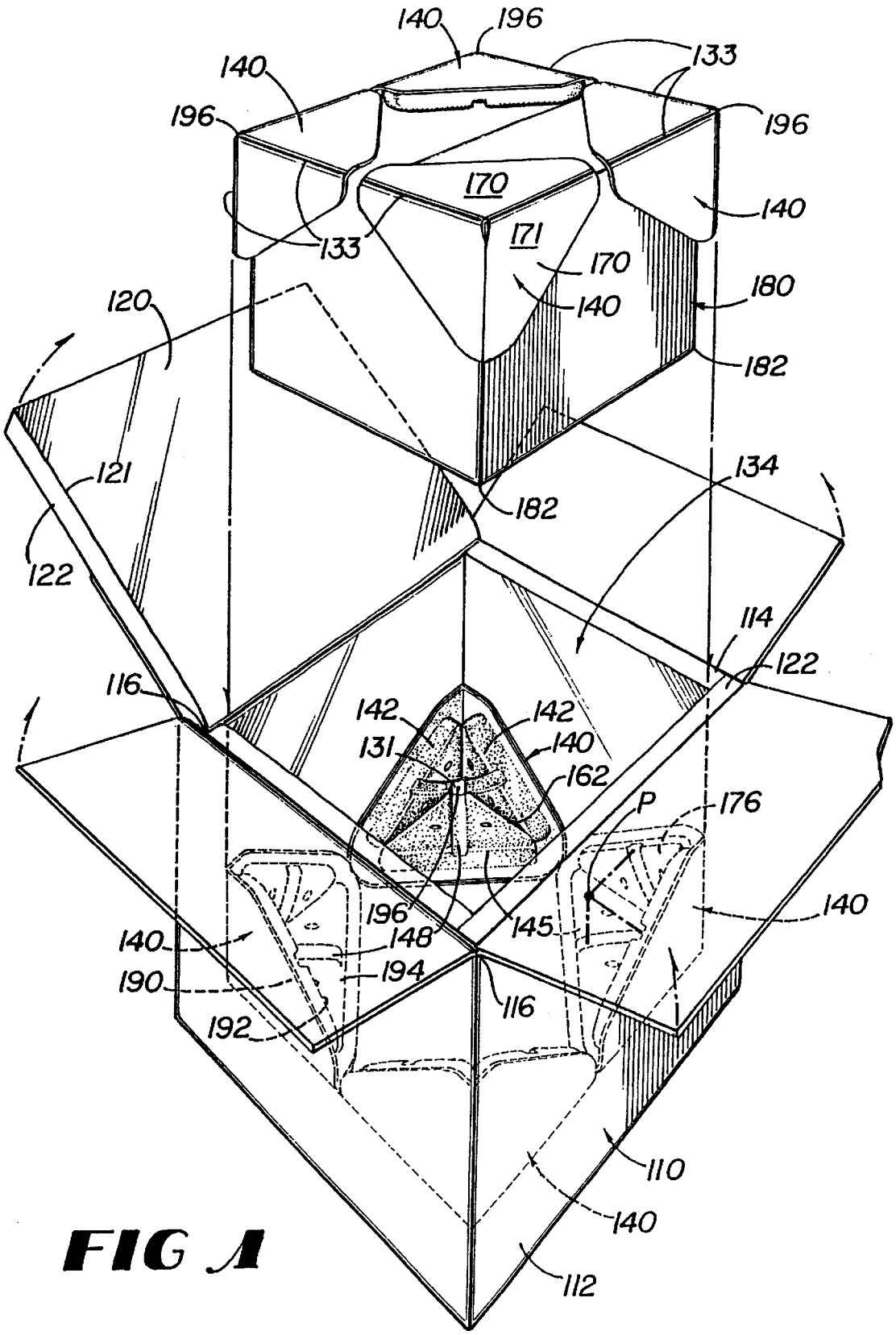
FIG. 1 is a perspective view of the container of the present invention.

The present invention provides a heat transfer device 140 for a container 110 defining a cavity 134 therein, comprising a heat transfer solution (not shown) for cooling the cavity 134; and means 141 for containing the solution, the containing means 141 comprising a reservoir-defining element 143 having a channel 148 therethrough which is in communication with the cavity 134 and which is disposed on the element 143 substantially in the direction of the flow of air through the cavity 134. In a further embodiment, the solution comprises a eutectic solution which has a preselected melting temperature.

In yet another embodiment, the present invention provides the above-described device wherein the reservoir-defining element 143 comprises three substantially equally shaped triangular members 142. Each such member 142 comprises a front face 158, an opposite rear face 160, two vertical side walls 162 interconnecting the faces 158 and 160, wherein each side wall 162 has a first end 164 and an opposed second end 166 and the first ends 164 of the side walls 162 are joined together at a junction 168, a rear wall 170 interconnecting the second ends 166 of the side walls 162, with the front face 158, the rear face 160, the side walls 162 and the rear wall 170 defining the reservoir 172 for each member 142, and means 174 for forming a trigonally pyramidal shaped void 176 defined by the three front faces 158 of the members 142, wherein the channel 148 is formed on each front face 158 of each member 142 in a direction which is perpendicular to the rear wall 170 and intersects the junction 168 of the two first ends 164 of the side walls 162.

In yet another embodiment, the three triangular members 142 are arranged with one of the members 145 intermediate the other two members 142 such that a line through each junction of each member which is perpendicular to the rear wall 170 of that member intersects each of the other lines at a point P which is exterior to the members 142 and is the center of the void 176 and with each of the side walls 162 of the intermediate member 145 being parallel to a juxtaposed side wall 162 of another member 142. In a still further embodiment, the rear faces 160 of the members 142 are co-extensive and form a unitary surface 171 and wherein a fold-line 133 is disposed in the surface 171 between, and parallel to, each of the juxtaposed sidewalls 162. In yet another embodiment, a surface 150 (or side slope) is formed at the intersection of the front face 158 with each of a respective juxtaposed side wall 162, each of the surfaces being 150 complementary in shape to each other. In a further embodiment, the shape of the surface 150 is a chamfer.

In an alternate embodiment, the rear faces 160 are coextensive and further comprising a means 176 for securing the junction, wherein the side walls 162 are disposed such that one member 145 is intermediate the other two 142 and its side walls 162 are parallel to a side wall 162 of each adjacent member 142 and the side walls 162 are spaced apart with a fold line 133 disposed therebetween, and further joining together the non-intermediate members 142 by folding along the fold-lines 133. In a still further embodiment, the means 176 for joining comprises a hook means (not shown) disposed on a selected one of the non-intermediate members 142 and a hook-receiving means (not shown) disposed on the other non-intermediate member 142. In a further embodiment (FIG. 9), the means for joining comprises a male member 502 and an opposed female interlocking member 504, wherein the male member 502 has a shaft portion 503 of a first selected width and a retention portion 505 of a second selected width which is greater than the first selected width and wherein the female member 504 defines a first slot 508 of a third selected width capable of receiving therethrough the portion 505 of the male member 502 having the second selected width and a second slot 510 of a fourth selected width, smaller than the third selected width and further capable of receiving the shaft portion 503 therein, whereby upon operation the male and female portions 502 and 504 interconnect to removably connect the non-intermediate members 142.

In a further embodiment, one or more separating means 400 are provided for preventing direct contact between the reservoir 172 and a corner 182 of the container 180. In yet another embodiment, the separating means 400 comprises one or more solution-free, raised protrusions on each of the front faces 158.

In another embodiment, the present invention provides the above-described device 140 wherein the reservoir 172 comprises a member having an outer surface 190 and an inner surface 192, wherein the inner surface 192 forms a trigonally pyramidal shaped void 176 comprised of three triangular inner faces each having a base edge 194 and an apex 196, and wherein the apexes 196 of each of the triangular faces meet and further wherein each of the triangular faces is substantially bisected by a channel 148 disposed from the apex 196 to the base edge 194.

In yet another embodiment (FIGS. 1–2), the present invention provides a container 110 for transporting a temperature-sensitive product, comprising a reclosable, insulated housing defining a cavity 134 therein, a product carrying container 180 having a plurality of corners 182 and capable of being disposed within the cavity 134, and a plurality of the devices 140 as set forth herein disposed within the cavity 134 so as to engage the corresponding plurality of corners 182 of the product carrying container 180.

In a further embodiment, the housing 110 comprises a durable outer layer 112 and an insulating inner layer 120, wherein the inner layer 120 is comprised of spun rock 122.

In yet another embodiment, the container 110 is substantially fluid impermeable. In an alternate embodiment, the container is coated with an energy reflective material (not shown).

Generally, the present invention involves the development of a shipping system capable of maintaining temperature ranges adequate for the protection of biological materials or other temperature sensitive materials. The temperature ranges of primary interest are 0 to 10° C., for liquid blood transport, −23 to −15° C., for frozen blood product transport, and 20–24° C. for platelet transport. By shifting the melting point of the cooling packs of the proposed system, the temperature range of other products can also be matched, thereby providing an ideal system for the shipment of pharmaceuticals, flowers, and temperature-sensitive foods. In all of these applications, the entire system is designed to be environmentally and user friendly, thus avoiding the restrictions on styrofoam and dry ice that limit conventional packing systems.

The essential concept behind the current invention is that the load is surrounded by a temperature-controlled, circulating air stream. This system is thereby essentially different from the conventional technique in which no such circulation is provided.

The overall arrangement is shown in FIGS. 1–10 and is described above. These Figures show various views of the system. Starting from the outside and progressing inward, the first component of the system is the outer box. This box is a conventional B-flute RSC. (The "flute" refers to the size of the convoluted center section of a cardboard box; "B" in particular designates the standard, approximately 2 mm section thickness commonly used for medium-sized boxes.) This box, however, may have a metallized outer section to reduce radiative heat transfer. This box also may have an inner wax layer to prevent condensation damage to the walls, as well as stitched seals to prevent seam failure due to condensation. When properly taped, the box also provides leak resistance.

The next component is the insulation, consisting of a 2.5 or 5.0 cm layer of rock wool inside a sheath of metallized film. This combination has several advantages over the styrofoam commonly used in insulated shipping containers. First, rock wool provides a slightly greater R value (the relative resistance to heat transfer) than styrofoam. Second, rock wool, being a by-product of iron ore processing, is environmentally safer than styrofoam; this wool is actually used as the growth matrix for hydroponic farming. Third, rock wool is much more flexible than styrofoam. Rock wool insulation can therefore be packed at the corners and joints, thus avoiding the gaps that cause substantial heat loss at the joints of styrofoam systems.

Figure 4A:
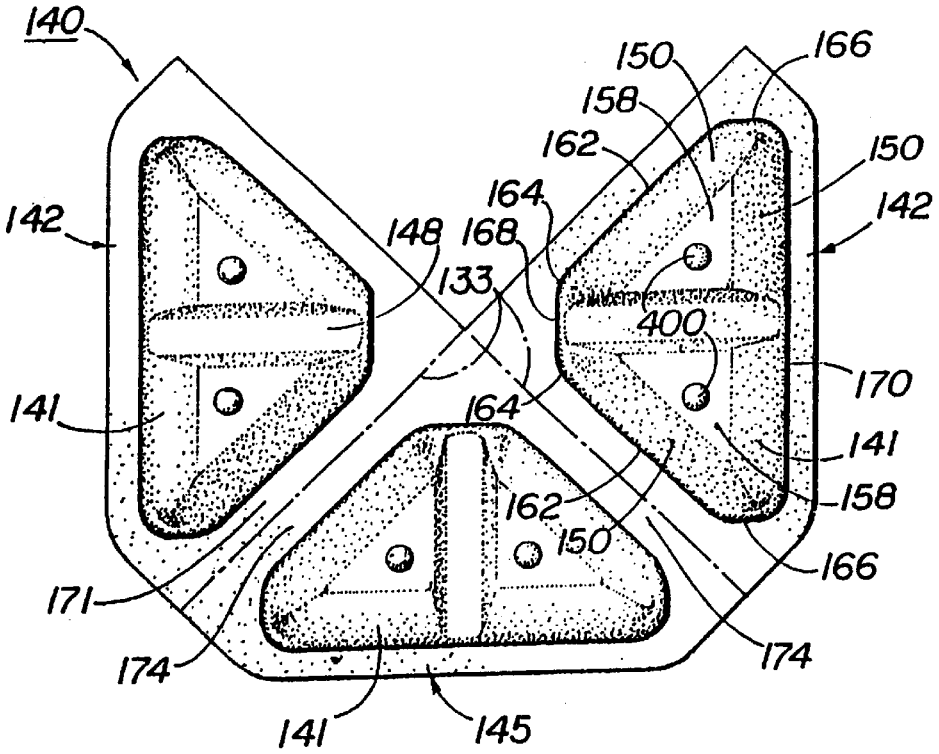
FIG. 4A is a top plan view of the cornerpiece used in the present invention.

The next component is the cooling packs (cornerpieces), which are placed at the corners of the inner chamber. A detailed face view of these packs/cornerpieces is shown in FIG. 4A and has been described above. These packs consist of three triangular sub-sections. When folded, these three sub-sections meet to form a three-faced pyramid, with an open base to receive the corner of the inner chamber box. Eight of these pyramids are thus required to match the eight corners of the inner chamber. Each of the triangular subsections has the illustrated center groove for added strength and enhanced air flow. Each sub-section also has the illustrated side slopes for high strength molding and easier box insertion. The sub-sections are filled with either water or methyl cellulose gel for approximately 0° C. transition; the addition of increasing amounts of sodium chloride provides successively lower transition points down to the eutectic limit. The entire assembly is formed from polystyrene or any similar, rigid plastic to ensure low temperature strength and the ability of the pack to maintain its shape after the cooling medium melts.

The packs are designed to leave air flow channels 131 at the corner when folded. These channels 131 thus provide the required heat transfer between the cooling medium and the circulating air. Saturated air tests of the top packs demonstrate a strong air flow from the lower tip of the packs. This strong air flow drives the circulation within the system, thus providing quite uniform air circulation.

The placement of the packs on the box corners ensures that the maximum cooling power is applied at the point of maximum heat transfer. The physical basis of this arrangement follows from the common observation that the corners of ice cubes melt before the side walls, due to the greater surface area per unit volume at the corners versus the walls. The placement of a pack at each corner ensures uniformity throughout the volume. This uniformity is thus further ensured regardless of the position of the box, thereby eliminating the problem of incorrect handling by shipping personnel.

The last component of the system is the internal load container, consisting of an RSC box. Like the outermost shell box, the internal load box is also shielded against condensation damage. The function of the internal box is to ensure that the air flow passages remain clear. This box is therefore mounted on the inside of the folded chill packs, as illustrated in FIG. 1. An additional benefit of this arrangement is that the internal box can be used as a collection vessel in the laboratory and then stored in a refrigerator until needed, thus avoiding the problems of carrying and cooling the entire system before shipment. When the load is ready, it can then be transferred to the shipping system without the heating that occurs when conventional systems are packed.

Figure 8:
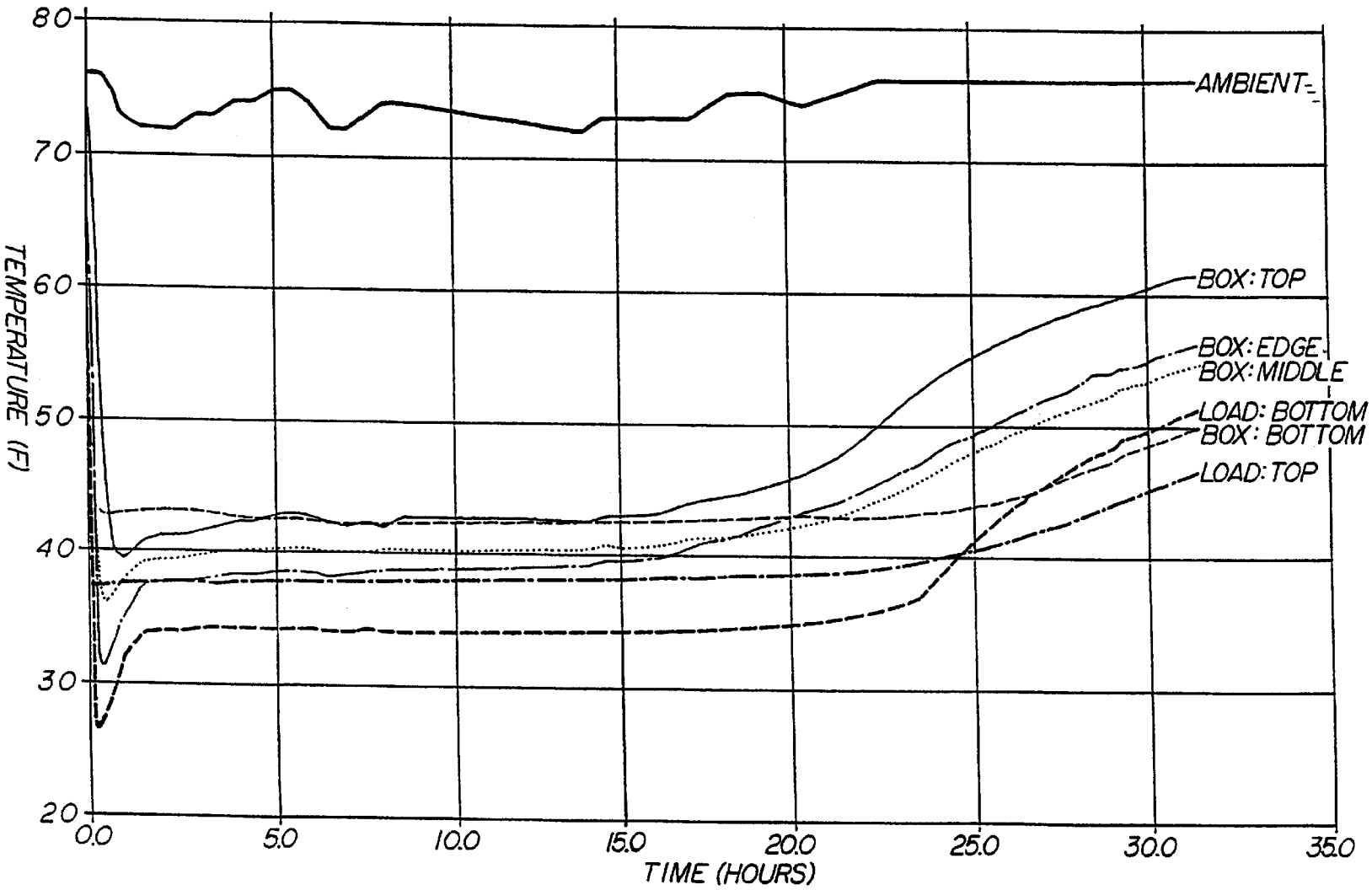
FIG. 8 shows the temperature profile of the inside of the container of the present invention over an approximately 35 hour period.

Containers, according to the present invention, have been assembled and tested with a variety of loads and ambient conditions. A representative test run is shown in FIG. 8. Note that the temperature is reported in ° F. rather than ° C. because the domestic box industry and its testing equipment are not metric. The target temperature range is thus 32 to 50° F., which corresponds to 0 to 10° C.

The results presented in FIG. 8 show that the system maintained the required load temperature for more than 30 hours. The system also showed the desired tight uniformity of all tested points, versus the large variations commonly observed for conventional systems. The system also reached the desired temperature range quite rapidly, in about 5 minutes, compared to the time spans of up to 2 hours or more commonly observed for conventional systems.

In addition to the curves, the tests also showed that when system failure finally did occur, the chill packs were completely melted. In contrast, conventional systems typically fail with some coolant still frozen. The new technology thus provides more complete utilization of the available coolant, thereby extending the useful shipping time. This improved utilization also allows for the use of less coolant for a given time period, compared to conventional systems. Because less coolant results in less weight, which is a crucial concern for express shipments, the new technology thus reduces shipping costs. In the case of this particular test, 3.5 pounds of coolant provided better performance than the 5 pounds of ice required for conventional systems, a significant improvement in both effectiveness and weight.

However, the temperature profiles shown in FIG. 8 indicate one factor to consider. Specifically, the curves show cooling a lower temperature region in the first half hour of operation. Although this drop did not reach the freezing point of blood, this behavior may be unsuitable for certain applications of the containers. One way of avoiding this problem is to allow the packs to warm to the melting point before utilization. This "equilibration" is essentially similar to the practice of using "glistening" ice for packaging, i.e., the ice is allowed to warm to the point of surface melting before utilization. Alternate Embodiment 5 describes one such method.

Occasional leaking of coolant at the seams occurs. Although this problem occurs infrequently, coolant leaks are avoided for most shipping systems. Therefore, Alternative Embodiment 4 below provides a further system wherein the coolant leak probability is further reduced.

In an alternative embodiment, a ventilated stand-off 400 on the faces of the cooling packs is incorporated to reduce the flow of heat from the load directly to the pack. Furthermore, the pure water in the cooling pack is replaced by a gel, again decreasing the heat flow, while also reducing the leakage problem. To maintain the same cooling capacity, the decrease in available thickness due to the addition of the stand-offs will be compensated by increasing the length of the packs.

The stand-offs 400 may also be mounted on the backs of the packs (not shown). This arrangement has two benefits. First, mounting the stand-offs on each side of the packs ensures that the shipping personnel cannot accidentally mount them improperly. Second, the stand-offs on the sides facing the insulation reduce the transfer of heat directly from the insulation to the pack, thereby improving the effective life of the system.

Figure 2:
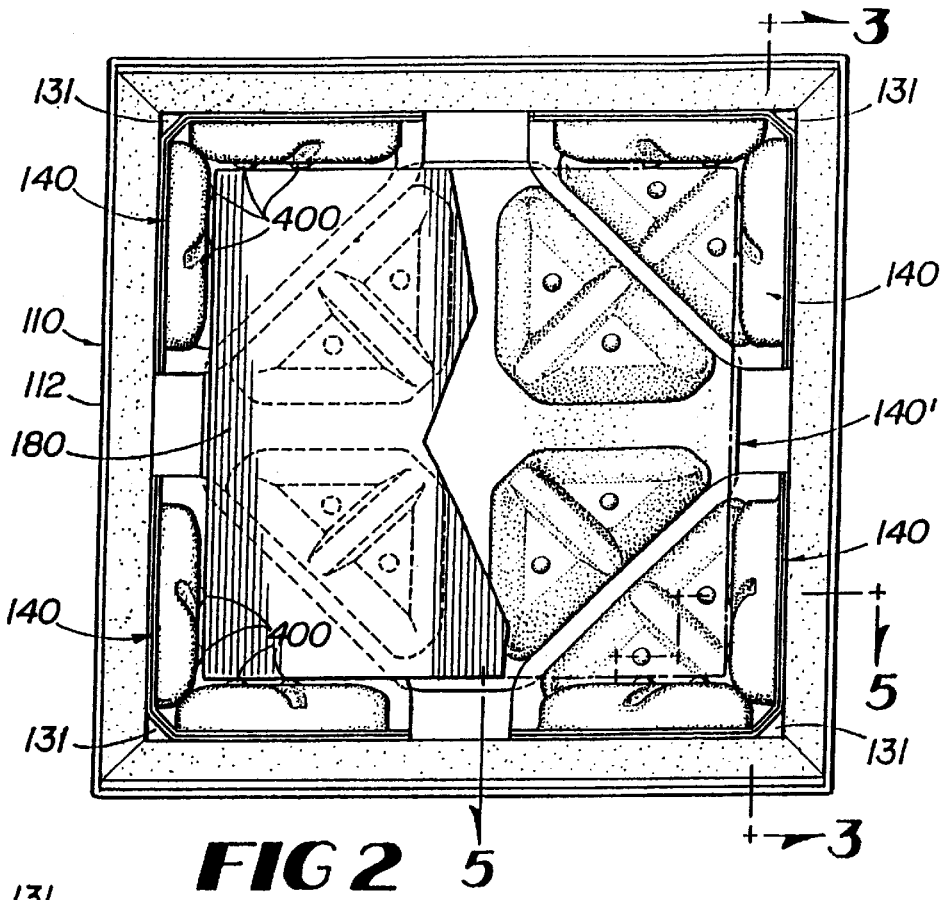
FIG. 2 is a top plan view of one embodiment of the container of the present invention.
Figure 3:
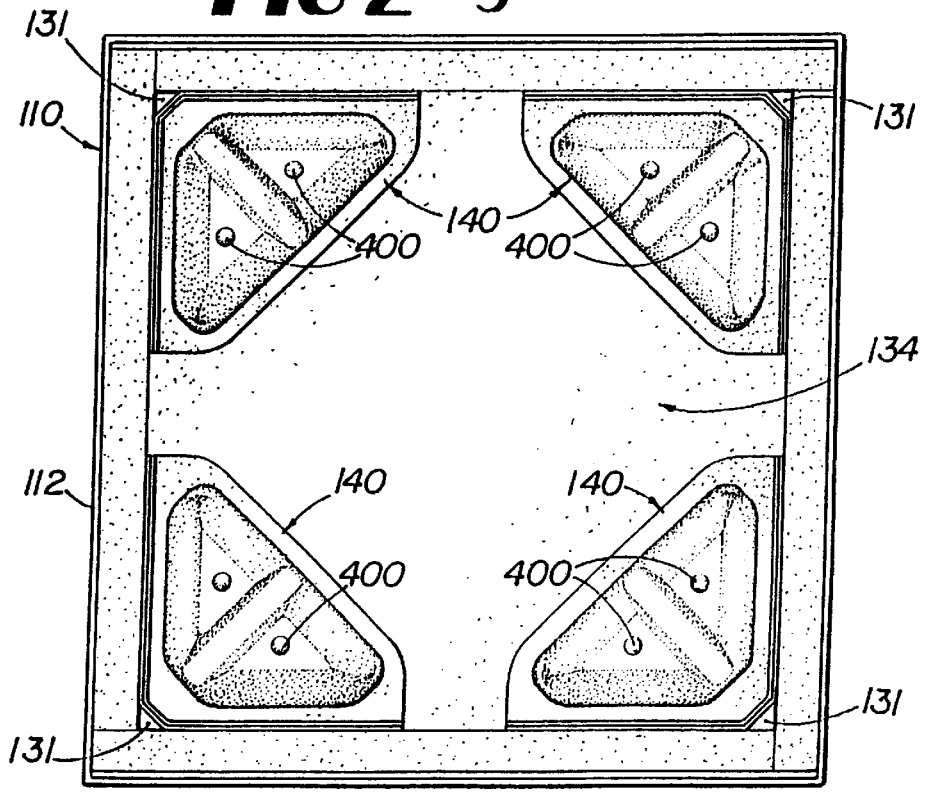
FIG. 3 is a top plan view of one embodiment of the container of the present invention.
Figure 4B:
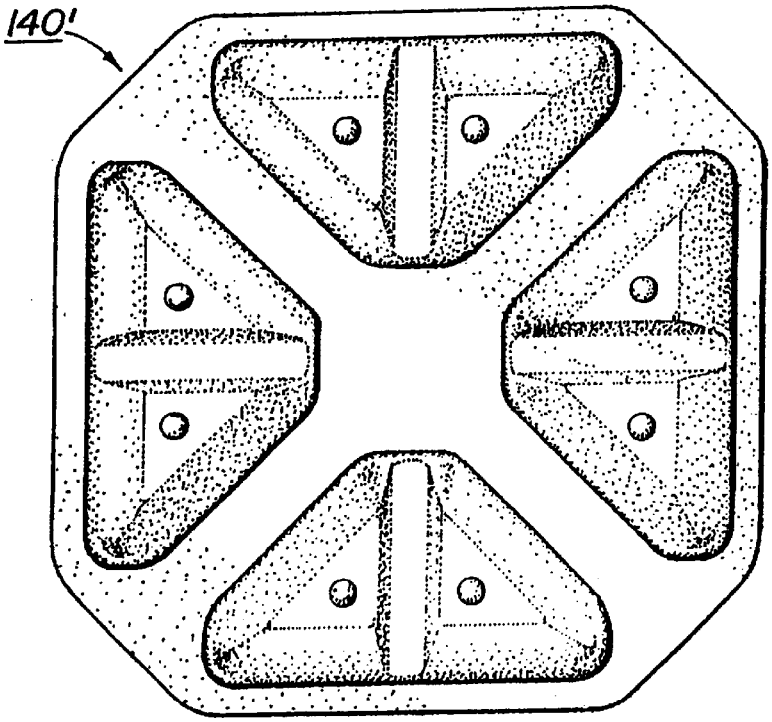
FIG. 4B is a top plan view of an alternate cooling piece used in the present invention.
Figure 5:
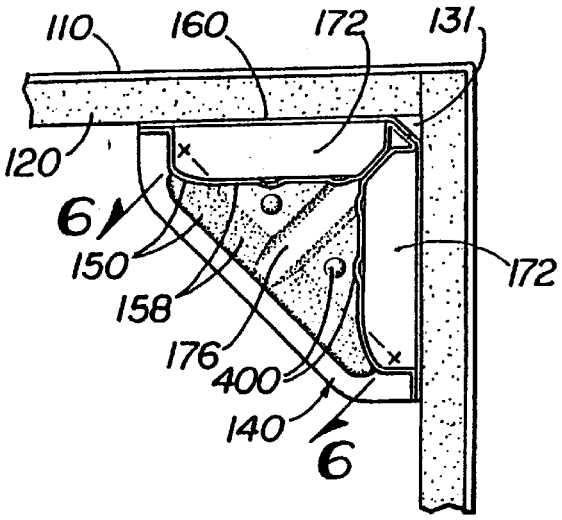
FIG. 5 is a top plan view of one of the corner pieces of the present invention in situ.

An additional modification that has also been designed is a cooling pack 140', FIG. 4B, to be mounted in the square residual face area shown in the FIG. 2. This pack 140' consists of four of the triangular sub-sections thereby forming the necessary square face geometry. The addition of this pack 140', along with optional 5.0 or even 7.5 cm insulation, is provides the very long shipping time capability needed for international transport and reduced rate, second day deliveries.

Two additional components can be added to the container of the invention. These components, consisting of plastic bag liners and absorbent materials, can improve the ability of the system to contain leaks should blood bags or similar containers accidentally break during shipment. This ability to contain such leaks may be required under international shipping rules that are now taking effect in some areas. The addition of these components, however, will not compromise the circulation patterns of the proposed system and will therefore not adversely affect the performance of the system.

Alternate Embodiment 1

An alternate embodiment of the present invention provides very long storage times at selected temperatures. In this embodiment, one entire cooling system is placed inside another. For example, the inner system could consist of a fully functional 12 inch cube with a 1 inch thick blanket and a 1 inch thick cooling pack, leaving an 8 inch payload box (12 inches minus two sides of insulation or 2 inches, minus the thickness of two packs). This entire system would be placed inside a 16 inch cube, again with 1 inch thick insulation and pack thickness, yielding the desired 12 inch payload.

When the existing single system finally fails, which in the case of liquid blood transport is 10° C., this system is still quite cool compared to the ambient temperatures which may exceed 70° C. Under the new approach, however, the inner box would see an ambient only slightly greater than its target temperature. Since the rate of heat transfer is directly proportional to the temperature difference, the innermost payload is maintained at the target temperature for extensive time periods.

This system could be used for the international transport of temperature sensitive materials, consisting primarily, but not exclusively of, biological samples and compounds, as well as pharmaceuticals.

Alternate Embodiment 2

Figure 10:
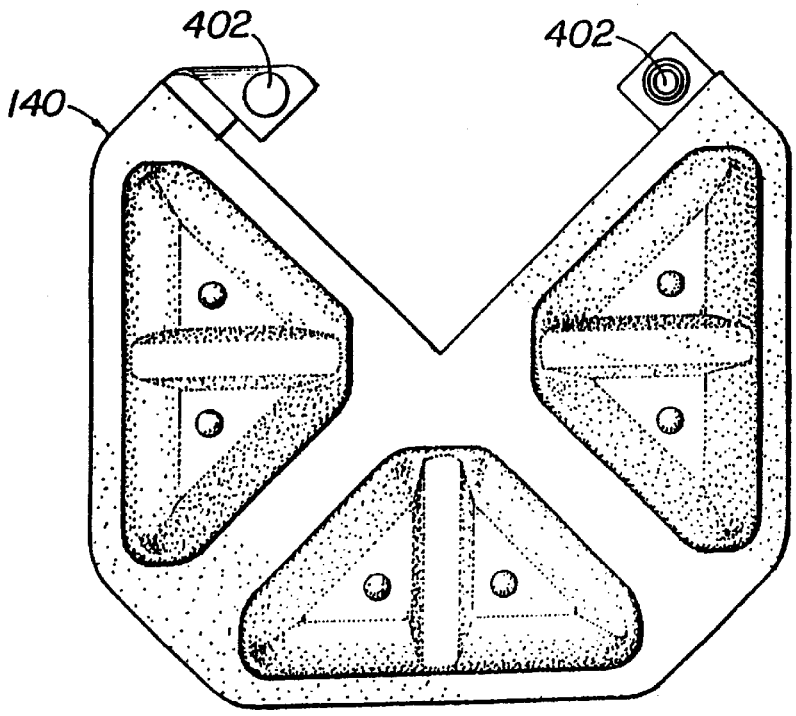
FIG. 10 shows a top plan view of a further embodiment of the cornerpiece of the invention.

The cooling packs of the present invention can also be modified for enhanced performance. First, ribs can be added to each section for increased strength. These ridges are parallel to the central pack channel to provide easier insertion at the box edges. Second, the sections may be extended to include more volume, and thus enhanced cooling capacity. Third, each of the sections may use the previously described stand-offs 400, which prevent excessive cooling of the payload at the corner, regardless of the starting temperature of the packs. Fourth, as seen in FIG. 10, the packs also have a snap 402 closure mechanism to hold the frozen units in the proper position. Fifth, the center sections of the packs can be severed to improve the flexibility of the packs. This embodiment could be further enhanced by using flexible web sections at the periphery to join the three pack sub-sections.

Alternate Embodiment 3

Figure 9:
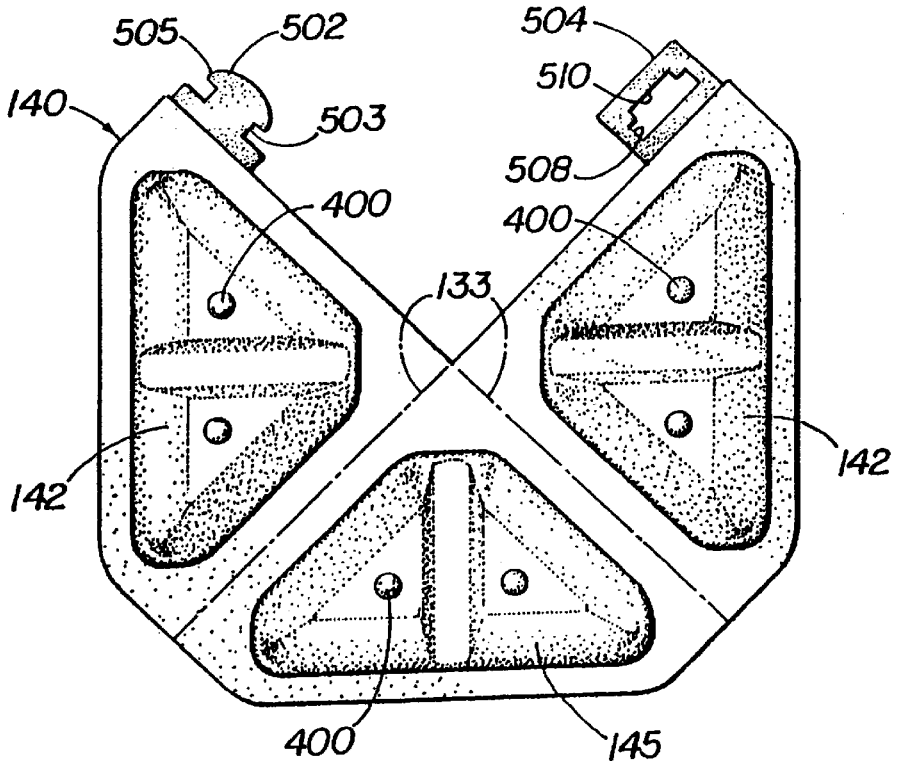
FIG. 9 shows a top plan view of a further embodiment of the cornerpiece of the invention.

The cooling packs of the present invention can be further modified for enhanced performance. As shown in FIG. 9, and further as described in Alternate Embodiment 2, rather than snaps, a male/female locking system can be used to hold the units in proper position. The preferability of using this locking system stems from the observation that the male/female lock components can be molded into place during fabrication of the units themselves, thereby not requiring additional processing of the units during assembly. Upon operation, the male connector "T" portion is disposed through the female connector larger slot and the male connector post is allowed to seat within the female connector smaller slot thereby preventing passage of male "T" portion back trough the larger slot unless the "T" portion is raised in the direction from the smaller slot toward the larger slot.

Alternate Embodiment 4

Figure 6:
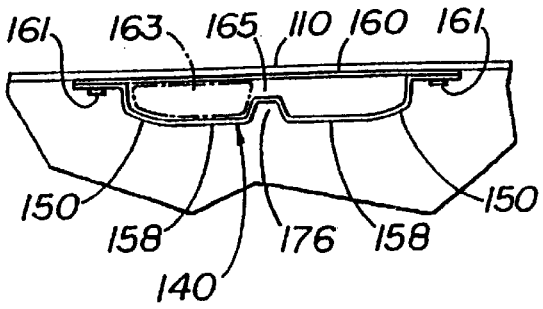
FIG. 6 is a side profile view of the cornerpiece of the invention.
Figure 7:
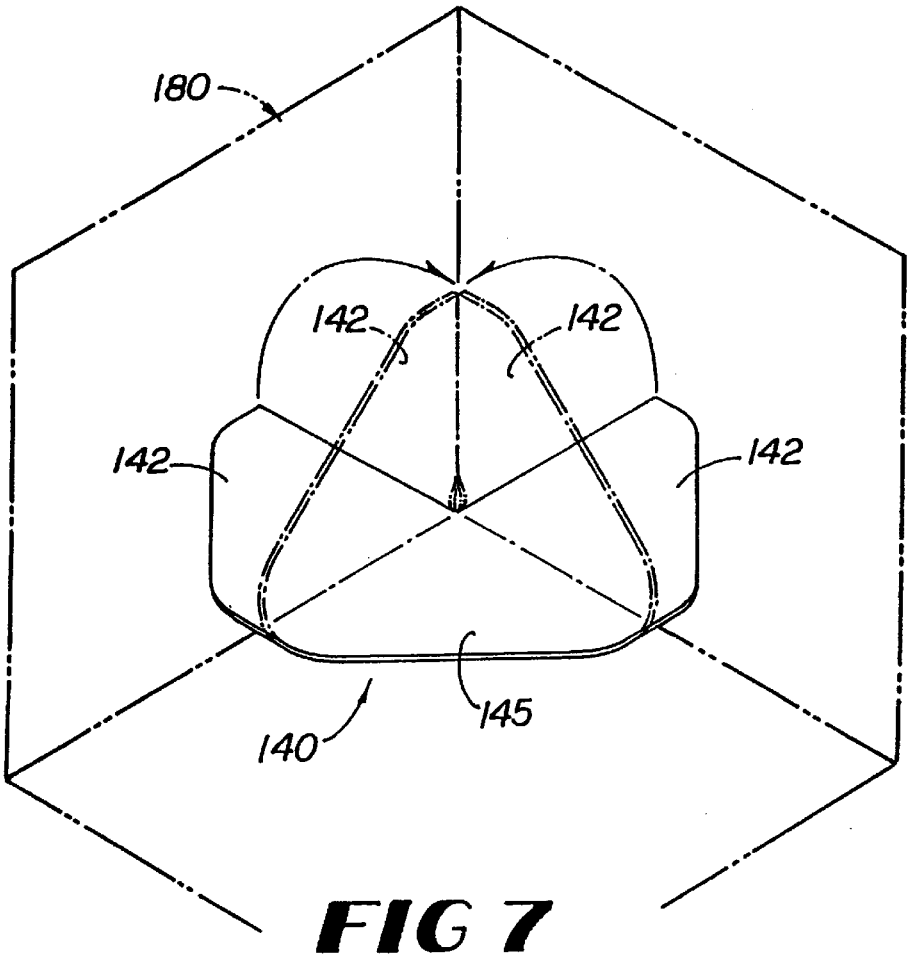
FIG. 7 shows the method of folding a flattened cornerpiece template into the cornerpiece of the present invention.

The cooling packs of the present invention can be further enhanced as shown in FIG. 6. The cooling packs may themselves include snap mechanisms 161 or other means for securing the back surface 160 to the remainder of the pack. In such a configuration, flexible coolant packs 163 may be placed inside the cavity 165 in the main pack and secured in place by operation of the snap mechanisms 161. This arrangement provides the following advantages. First, the inside coolant packs 163 are separately sealed, thereby reducing the likelihood of extensive leaking in the system. Second, the main coolant pack seals are not subject to flexure when the outer shell is opened or closed, thereby prolonging the useful life of the main coolant packs. Finally, various inside cooling packs 163 may be used to obtain different cooling properties without requiring the use of separate main cooling packs 140. Therefore, the same main cooling packs can be used for cryogenic applications and then reused for other application, such as platelet transport.

Alternate Embodiment 5

In addition, the cooling packs of the present invention can also been modified for enhanced performance for the transport of platelets. Such a use involves the introduction of a special cooling agent for use in the cooling packs and also the use of a set of handling procedures.

The cooling agent for use in transporting platelets consists of a chemical mixture and a small amount of sand, higher order olefin (e.g. C-30 or greater) or other inert means for enhancing nucleation. The use of a higher order olefin as the means for enhancing nucleation is that it has the additional benefit of existing in the liquid state at 37° C. and thus is capable of being pumped into the packs during manufacture at an "elevated" temperature without the need for using separate equipment to handle the means for enhancing nucleation. The chemical mixture is chosen so as to have a melting point of from 20 to 24° C., preferably from 22 to 23° C., and most preferably about 23° C. In addition, the chemical mixture preferably is of low toxicity and flammability, as well as low cost. Moreover, it is preferable if the chemical mixture can be disposed of easily.

One suitable chemical mixture is a combination of alpha olefins. In a preferred embodiment, an approximately 51 wt. % C-18 to 49 wt % C-20 to C-24 olefin mixture is used (C-18, C-20, C-21, C-22, C-23, C-24 and C-30 α-olefin, Chevron, Houston, Tex.).

The sand, higher order olefin, or other inert means for nucleating is used to provide a convenient nucleation site in the otherwise smooth container. Such nucleation helps to prevent undesirable supercooling.

The melting point of 23° C. is preferable because of similar supercooling considerations. Moreover, FDA regulations specify that platelets must be maintained at 22±2° C. While melting of phase changes materials always occurs at the specified melt temperature, supercooling can result in significant, undesirable depressions of the freezing point. Using a 23° C. melting point as opposed to 22° C. therefore provides further protection against supercooling.

In addition, a novel preparation procedure is preferably employed. The exact parameters and details of this preparation procedure depend upon the desired application. For general use, conditions above and below the target temperature of 22° C. must be anticipated.

Additionally, an optional pre-conditioning step may be employed. This step involves heating of all packs to 37° C. to eliminate any history or memory effects, i.e., melting all components at this higher temperature ensures that each use commences with the same, initially liquid conditions. This optional step provides a system where the initial liquid/solid fraction from the previous use is not a concern.

Preparation under these conditions involves the use of common blood bank equipment: a 4° C. refrigerator and a 37° C. "warm" waterbath. For a typical container of eight packs, four packs are placed in the refrigerator (optionally in a waterbath), and four packs are placed in the warm waterbath. When needed for shipment, the packs are then placed alternatively about the eight corner points of the box, i.e., warm everywhere next to cold. Because the specific heats are approximately the same for solid and liquid forms, and the lower temperature difference (23−4=1920 C.) is nearly equivalent to the high temperature difference (37−23=14° C.), the warm and cool packs rapidly equilibrate. After equilibrium is reached, about half of the material in the packs is in the liquid phase, and half is in the solid phase. The liquid material thus protects against cold external temperatures, while the solid phase protects against hot external temperatures.

Alternatively, if only very cold external temperatures are expected, all of the packs may preferably be warmed to approximately 24° C. Conversely, if only very hot temperatures are expected, all of the packs should be conditioned to approximately 20° C.

Finally, the present invention also provides a rapid preparation technique, suitable for emergency use. Under this approach, the packs are placed in the same respective hot and cold baths used for general shipments. Instead of leaving the packs in the baths long enough to reach the bath temperature, however, the packs are removed early. Suitable results can be obtained in as little as 20 minutes. Again, assuming approximately equal temperature differentials, the net system equilibrates rapidly to the target platelet transportation temperature.

What is claimed is:

1. A heat transfer device for a container defining a cavity therein, comprising:

a. a heat transfer solution for cooling the cavity; and b. means for containing the solution, the containing means comprising a reservoir-defining element comprising at least three generally triangular members, at least one of said generally triangular members having a channel therethrough which is in communication with the cavity and which is disposed on the element substantially in the direction of the flow of air through the cavity.

2. The device of claim 1, wherein the solution comprises a eutectic solution which has a preselected melting temperature.

3. The device of claim 1, wherein the reservoir-defining element comprises three substantially equally shaped triangular members, wherein each member comprises:

a. a front face;

b. an opposite rear face;

c. two vertical side walls interconnecting the faces, wherein each side wall has a first end and an opposed second end and the first ends of the side walls are joined together at a junction;

d. a rear wall interconnecting the second ends of the side walls, with the front face, the rear face, the side walls and the rear wall defining the reservoir for each member; and e. means for forming a trigonally pyramidal shaped void defined by the three front faces of the members, wherein the channel is formed on each front face of each member in a direction which is perpendicular to the rear wall and intersects the junction of the two first ends of the side walls.

4. The device of claim 3, wherein the three triangular members are arranged with one of the members intermediate the other two members such that a line through each junction of each member which is perpendicular to the rear wall of that member intersects each of the other lines at a point which is exterior to the members and is the center of the void and with each of the side walls of the intermediate member being parallel to a juxtaposed side wall of another member.

5. The device of claim 4, wherein the rear faces of the members are co-extensive and form a unitary surface and wherein a fold-line is disposed in the surface between, and parallel to, each of the juxtaposed sidewalls.

6. The device of claim 5, wherein a surface is formed at the intersection of the front face with each of a respective juxtaposed side wall, each of the surfaces being complementary in shape to each other.

7. The device of claim 6, wherein the shape of the surface is a chamfer.

8. The device of claim 4, wherein the rear faces are coextensive and further comprising a means for securing the junction, wherein the side walls are disposed such that one member is intermediate the other two and its side walls are parallel to a side wall of each adjacent member and the side walls are spaced apart with a fold line disposed therebetween, and further having a means for joining together the non-intermediate members by folding along the fold-lines.

9. The device of claim 8, wherein the means for joining comprises a hook means disposed on a selected one of the non-intermediate members and a hook-receiving means disposed on the other non-intermediate member.

10. The device of claim 8, wherein the means for joining comprises a male member and an opposed female interlocking member, wherein the male member has a shaft portion of a first selected width and a retention portion of a second selected width which is greater than the first selected width and wherein the female member defines a first slot of a third selected width capable of receiving therethrough the portion of the male member having the second selected width and a second slot of a fourth selected width, smaller than the third selected width and further capable of receiving the shaft portion therein, whereby upon operation the male and female portions interconnect to removably connect the non-intermediate members.

11. The device of claim 1, further comprising separating means for preventing direct contact between the reservoir and a corner of the container.

12. The device of claim 11, wherein the separating means comprises one or more solution-free, raised protrusions on each of the front faces.

13. The device of claim 1, wherein the reservoir comprises a member having an outer surface and an inner surface, wherein the inner surface forms a trigonally pyramidal shaped void comprised of three triangular inner faces each having a base edge and an apex, and wherein the apexes of each of the triangular faces meet and further wherein each of the triangular faces is substantially bisected by a channel disposed from the apex to the base edge.

14. A container for transporting a temperature-sensitive product, comprising:

a. a reclosable, insulated housing defining a cavity therein;

b. a product carrying container having a plurality of corners and capable of being disposed within the cavity; and c. a plurality of the devices of claim 1 disposed within the cavity so as to engage the corresponding plurality of corners of the product carrying container.

15. The container of claim 14, wherein the housing comprises a durable outer layer and an insulating inner layer, wherein the inner layer is comprised of spun rock.

16. The container of claim 15, wherein the container is substantially fluid impermeable.

17. The container of claim 15, wherein the container is coated with an energy reflective material.

* * * * *